US005102479A

United States Patent [19]

Nakamura et al.

[11] Patent Number: 5,102,479

[45] Date of Patent: Apr. 7, 1992

[54] HIGH STRENGTH NON-HEAT REFINING FREE CUTTING STEELS

[75] Inventors: Sadayuki Nakamura, Mie; Toshihiko Matsubara; Yasunori Sato, both of Wako, all of Japan

[73] Assignees: Daido Tokushuko K.K., Aichi; Honda Giken Kogyo K.K., Tokyo, both of Japan

[21] Appl. No.: 742,125

[22] Filed: Aug. 8, 1991

[30] Foreign Application Priority Data

Aug. 10, 1990 [JP] Japan ..... 2-212107

[51] Int. Cl.[5] ..... C21D 1/10

[52] U.S. Cl. ..... 148/333; 148/12 F; 148/12 EA; 420/111

[58] Field of Search ..... 148/12 EA, 12 F, 333; 420/87, 104, 111

[56] References Cited

U.S. PATENT DOCUMENTS 3,489,620 1/1970 Current ..... 148/333

FOREIGN PATENT DOCUMENTS 0156717 12/1981 Japan ..... 148/333

0990861 1/1983 U.S.S.R. ..... 148/333

*Primary Examiner*—R. Dean

*Assistant Examiner*—Sikyin Ip

*Attorney, Agent, or Firm*—Sughrue, Mion, Zinn, Macpeak & Seas

[57] ABSTRACT

A non-heat refining steel having a high fatigue strength in addition to an excellent machinability, which consists essentially of 0.30–0.50 wt % of C, 0.35–0.70 wt % of Si, 0.80–1.40 wt % of Mn, 0.30–0.80 wt % of Cr, 0.05–0.35 wt % of V, not more than 0.15 wt % of S and not more than 0.35 wt % of Pb so that (S+Pb) is not less than 0.06 wt % and (S+Pb/4) is not more than 0.15 wt %, 0.0003 to 0.0050 wt % of Ca, not more than 0.010 wt % of Al, 0.0015–0.0030 wt % of O and the balance of being Fe and inevitable impurities, and has a micro-structure composed of 10 to 40% by area of ferrite and balanced pearlite after hot working and air cooling.

4 Claims, No Drawings

HIGH STRENGTH NON-HEAT REFINING FREE CUTTING STEELS

BACKGROUND OF THE INVENTION

1. Field of the Invention

This invention relates to a high strength non-heat refining free cutting steel having high strength as well as excellent machinability (free cutting property) and suitable for use as materials for components of various machine structures such as an automobile requiring the machinability at the time of manufacture and the high strength at the time of practical use.

2. Description of the Prior Art

Heretofore, it has been tried in various fields to apply non-heat refining steels which are not subjected to quench-and-temper treatment. The conventional non-heat refining steels have a hardness up to Rockwell C 25 in the majority cases, and it is relatively easy to machine them because they have been used mainly instead of quench-and-tempered medium carbon steels.

In addition, if it is necessary to further improve the machinability, the steels are added with free cutting elements such as S, Pb and the like in proper quantity. In this case, since the hardness of the steels is low and the notch sensitivity is not so high, therefore the deterioration of the strength is not brought on.

However, in case of the non-heat refining steels having a hardness exceeding Rockwell C 25, there is a problem in that the steels are apt to be deteriorated in the fatigue strength by containing the free cutting elements such as S, Pb and so on in order to improve the machinability of the steels.

SUMMARY OF THE INVENTION

The present invention is made to solve the aforementioned problem of the prior art and it is an object to provide a high strength non-heat refining free cutting steel which is superior in both machinability and strength.

The construction of the high strength non-heat refining free cutting steel according to this invention for attaining the aforementioned object is characterized by consisting essentially by weight percentage of 0.30 to 0.50% of C, 0.35 to 0.70% of Si, 0.80 to 1.40% of Mn, 0.30 to 0.80% of Cr, 0.05 to 0.35% of V, not more than 0.15% of S and not more than 0.35% of Pb so that (S+Pb) is not less than 0.06% and (S+Pb/4) is not more than 0.15%, 0.0003 to 0.0050% of Ca, not more than 0.010% of Al, 0.0015 to 0.0030% of O and the balance of being Fe and inevitable impurities, and having a microstructure composed of 10 to 40% of ferrite and balanced pearlite by area percentage after hot working and air cooling. And in the preferred embodiments of this invention, it is desirable to limit the weight percentages of C and Cr to not more than 0.45% and 0.70%, respectively.

DETAILED DESCRIPTION OF THE INVENTION

The reason why the chemical composition (by weight percentage) and the microstructure of the high strength non-heat refining free cutting steel according to this invention are limited to the above-mentioned ranges will be described below.

C: 0.30 to 0.50%

Carbon is a principal element decisive for the hardness of the steel after hot plastic working such as hot forging and air cooling, and it is necessary to be added in an amount of not less than 0.30%. However, if carbon is contained in excess, the area percentage of pearlite increases, the notch sensitivity becomes higher and the toughness of the steel is degraded, so that the upper limit should be 0.50% or 0.45% preferably.

Si: 0.35 to 0.70%

Although silicon is used as a deoxidizing element in ordinary, it is contained positively in order to improve the machinability by controlling the composition of oxides in the steel according to this invention.

In this case, the melting point of the oxide is required to be low so that the oxide may be effective for improving the machinability without affecting the strength of the steel. In this sense, it is important to limit the Si content within a range of 0.35 to 0.70% in the steel according to this invention. Namely, when the Si content is less than the above-mentioned range, inclusions containing a large quantity of alumina are formed and the effect for improving the machinability comes to be not so remarkable. And if the Si content is more than the above-mentioned range, it is difficult to reduce Al content and the effect for the machinability becomes ineffective since the inclusions containing alumina in large quantities are formed also in this case. Therefore, the Si content is limited within the range of 0.35 to 0.70%.

Mn: 0.80 to 1.40%

Manganese is a very effective element for improving the toughness of a ferrite-pearlite structure. In order to obtain such an effect, it is necessary to contain the element in an amount of not less than 0.80%. However, if manganese is contained in large quantities, the toughness of the steel is degraded owing to formation of bainite even in case of air cooling. Therefore, it is the most suitable to define the Mn content within a range of 0.80 to 1.40%.

Cr: 0.30 to 0.80%

Chromium is an effective element for improving the toughness of the ferrite-pearlite structure. In order to obtain such an effect, it is necessary to contain the element in an amount of not less than 0.30%. However, if chromium is contained in large quantities, the toughness of the steel is apt to deteriorate owing to the formation of bainite, so that the upper limit should be 0.80% or 0.70% preferably.

V: 0.05 to 0.35%

Vanadium is an effective element for increasing the hardness of ferrite in the ferrite-pearlite structure and a principal element of the non-heat refining steel. And it is necessary to control V content in accordance with the desired hardness and the size of a work piece (which affects the cooling rate), but it is possible to meet requirements in ordinary components by limiting the V content within a range of 0.05 to 0.35%, and the machinability and the toughness of the steel are not influenced comparatively by limiting the V content in the range mentioned above.

S: not more than 0.15%

Sulfur improves the machinability of the steel by combining with manganese in the steel to form MnS inclusions. However, if sulfer is contained in large quantities, the strength and the toughness of the steel are degraded. Therefore, it is necessary to limit the S content to not more than 0.15%.

Pb: not more than 0.35%

Lead improves the machinability of the steel by precipitating in the steel as granular metallic lead. The optimum content of lead is within a range of not more than 0.35% independently.

S+Pb: not less than 0.06%

Although the effects of sulfur and lead on the machinability depends on a manner of the machine work in the strict sense, the effects are similar to each other if the elements are added in the same amount by the weight percentage in the case of drilling or the like in which the effects of these elements are remarkable. And it is possible to obtain the remarkable effect for improving the machinability by adding sulfur and lead in a total amount of not less than 0.06%.

S+Pb/4: not more than 0.15%

Sulfur and lead show the remarkable effect for improving the machinability as described above. However, it is found that sulfur is four times more harmful to the fatigue strength of the steel than lead as a result of investigating comparatively the effect of sulfur and lead on the fatigue strength of the steel within a range of chemical compositions according to this invention. Therefore, it is necessary to limit the value of (S+Pb/4) to not more than 0.15% since a bad influence on the fatigue strength becomes remarkable if the value of (S+Pb/4) exceeds 0.15%.

Ca: 0.0003 to 0.0050%

Calcium is a useful element for improving the machinability of the steel by controlling the composition of oxides similarly to silicon. Although the proper content of calcium depends on contents of oxygen, aluminum and silicon, it is most suitable to contain calcium within a range of 0.0003 to 0.0050% in the chemical composition range of the steel according to this invention.

Al: not more than 0.010%

Aluminum is a strong deoxidizing element. However, when aluminum is contained in large quantities, it is difficult to improve the machinability of the steel owing to formation of the inclusions containing a large quantity of alumina even if Si and Ca contents are controlled. Therefore, it is necessary to limit the Al content to not more than 0.010%.

O: 0.0015 to 0.0030%

Content of oxygen in steels is decreasing year after year by, for example, filling up steel making equipment such as RH degassing process. However, it is necessary to limit O content in a suitable range from a viewpoint of controlling the oxide composition in order to improve the machinability of the steel. When the O content is not more than 0.0015%, it is difficult to obtain oxides in a quantity sufficient to improve the machinability of the steel. And when the O content exceeds 0.0030%, the probability that large oxides are formed becomes higher and the fatigue strength of the steel is affected harmfully. Therefore, the O content is defined as a range of 0.0015 to 0.0030%.

Microstructure: ferrite and pearlite

Area percentage of ferrite: 10 to 40%

When a medium carbon steel contained with manganese and chromium is cooled in air from a high temperature, a ferrite and pearlite structure or a ferrite-pearlite-bainite structure is produced in general. In this case, banite is excellent in the toughness more than pearlite, but bainite is not desirable because the toughness of medium carbon bainite is not so high, and bainite reduces the ferrite percentage remarkably and deteriorates the toughness of the steel on the whole. When the ferrite percentage in area increases, the toughness is improved but the hardness of the steel is degraded. Conversely, when the ferrite percentage decreases, the toughness of the steel is deteriorated. Therefore, it is suitable to define the amount of ferrite as a range of 10 to 40% by area percentage. The ferrite percentage depends on the chemical composition of the steel, work piece temperature for forging, forging temperature, work piece temperature at the time of finishing forging, cooling rate and so on, and adjustable by controlling these factors.

In the high strength non-heat refining free cutting steel according to this invention has the above-mentioned chemical composition and microstructure, the toughness of the matrix is improved by determining the optimum value balancing among the contents of carbon, mangness and chromium, and the influence of the inclusions is reduced by determining the suitable range considering degree of the harmfulness and finding the optimum composition possible to improve the machinability in a small quantity so as to obtain a high strength non-heat refining free cutting steel having both high strength and excellent machinability.

EXAMPLE

Each of steels having chemical compositions as shown in the following Table 1 was cast into an ingot after being melted in an arc furnace, and then made into a billet of 150 mm square by hot rolling.

Then, the billet was made into rods of 25 mm and 50 mm in diameter by hot forging.

The rod having a diameter of 25 mm was applied for a microscopic examination, measurement of the ferrite percentage and a fatigue test using an Ono-type rotary bending tester, and the rod having a diameter of 50 mm was applied for a machinability test by drilling and turning using hard metal tools. And obtained results are shown in Table 2. In this table, the drilling machinability and the turning machinability were expressed relatively with percentages against the machinability of comparative steel No. 7 which is settled as a standard.

TABLE 1

| Kind of Steel | Steel No. | Chemical Composition (wt %.) | | | | | | | | | | |
|---|---|---|---|---|---|---|---|---|---|---|---|---|
| | | C | Si | Mn | P | S | Cu | Ni | Cr | Mo | V | Pb |
| Invention Steel | 1 | 0.31 | 0.42 | 0.98 | 0.012 | 0.052 | 0.05 | 0.15 | 0.68 | 0.00 | 0.10 | 0.22 |
| | 2 | 0.35 | 0.46 | 1.08 | 0.006 | 0.050 | 0.01 | 0.07 | 0.55 | 0.00 | 0.18 | 0.20 |
| | 3 | 0.41 | 0.54 | 1.35 | 0.019 | 0.058 | 0.00 | 0.04 | 0.50 | 0.04 | 0.31 | 0.24 |
| | 4 | 0.44 | 0.62 | 1.28 | 0.025 | 0.049 | 0.29 | 0.22 | 0.38 | 0.02 | 0.08 | 0.28 |
| | 5 | 0.37 | 0.55 | 1.05 | 0.015 | 0.089 | 0.09 | 0.18 | 0.49 | 0.00 | 0.11 | 0.18 |
| | 6 | 0.36 | 0.50 | 1.07 | 0.010 | 0.135 | 0.00 | 0.00 | 0.55 | 0.02 | 0.10 | 0.05 |
| Comparative Steel | 7 | 0.40 | 0.24 | 0.77 | 0.014 | 0.015 | 0.07 | 0.05 | 0.11 | 0.00 | 0.10 | 0.00 |
| | 8 | 0.25 | 0.22 | 0.71 | 0.015 | 0.055 | 0.06 | 0.10 | 0.15 | 0.01 | 0.11 | 0.18 |
| | 9 | 0.38 | 0.25 | 1.52 | 0.015 | 0.053 | 0.15 | 0.11 | 0.44 | 0.02 | 0.15 | 0.22 |
| | 10 | 0.50 | 0.20 | 1.55 | 0.019 | 0.090 | 0.13 | 0.11 | 0.52 | 0.00 | 0.10 | 0.20 |
| | 11 | 0.40 | 0.22 | 1.39 | 0.017 | 0.165 | 0.08 | 0.07 | 0.83 | 0.01 | 0.10 | 0.02 |

TABLE 1-continued

| Kind of Steel | Steel No. | Chemical Composition (wt %) S + Pb/4 | S + Pb | Ca | Al | O | N |
|---|---|---|---|---|---|---|---|
| Invention Steel | 1 | 0.107 | 0.272 | 0.0008 | 0.003 | 0.0025 | 0.007 |
| | 2 | 0.100 | 0.250 | 0.0012 | 0.001 | 0.0022 | 0.009 |
| | 3 | 0.118 | 0.298 | 0.0009 | 0.001 | 0.0018 | 0.005 |
| | 4 | 0.119 | 0.329 | 0.0015 | <0.001 | 0.0018 | 0.012 |
| | 5 | 0.134 | 0.269 | 0.0011 | 0.002 | 0.0027 | 0.011 |
| | 6 | 0.148 | 0.185 | 0.0026 | 0.004 | 0.0022 | 0.008 |
| Comparative Steel | 7 | 0.015 | 0.015 | 0.0000 | 0.025 | 0.0018 | 0.008 |
| | 8 | 0.100 | 0.235 | 0.0001 | 0.025 | 0.0013 | 0.009 |
| | 9 | 0.108 | 0.273 | 0.0000 | 0.021 | 0.0012 | 0.008 |
| | 10 | 0.140 | 0.292 | 0.0003 | 0.012 | 0.0020 | 0.006 |
| | 11 | 0.170 | 0.185 | 0.0015 | 0.003 | 0.0021 | 0.006 |

TABLE 2

| Kind of Steel | Steel No. | Microstructure | Ferrite percentage in area (%) | Fatigue limit (kgf/mm$^2$) | Drilling Machinability (machining) efficiency ratio | Turning machinability by hard metal tool (tool life ratio) |
|---|---|---|---|---|---|---|
| Invention Steel | 1 | F + P | 41 | 45 | 240 | 540 |
| | 2 | F + P | 38 | 47 | 235 | 530 |
| | 3 | F + P | 22 | 52 | 235 | 500 |
| | 4 | F + P | 16 | 48 | 240 | 515 |
| | 5 | F + P | 24 | 46 | 250 | 530 |
| | 6 | F + P | 32 | 45 | 205 | 515 |
| Comparative Steel | 7 | F + P | 18 | 35 | 100 | 100 |
| | 8 | F + P | 55 | 30 | 230 | 180 |
| | 9 | F + P + B | 15 | 42 | 150 | 150 |
| | 10 | F + P + B | 2 | 40 | 95 | 235 |
| | 11 | F + P + B | 9 | 38 | 180 | 385 |

Remarks
F: ferrite
P: pearlite
B: bainite

As apparent from Table 1 and Table 2, in comparison with comparative steel No. 7 as a standard, which does not contain silicon positively nor free cutting elements such as sulfur and lead, the invention steels Nos. 1 to 6, which contain well-balanced carbon, manganese and chromium in the respective optimum ranges, silicon, calcium, aluminum and oxygen in the respective suitable ranges so as to control the oxide composition, sulfur and lead in the suitably controlled amounts, and have the microstructure composed of ferrite in the range of 10 to 40%, show fairly high fatigue strength and remarkably excellent free cutting properties represented by the drilling machinability and the turning machinability in either case.

Contrary to above, it is found that the comparative steels No. 8 to 11 which are out of the range limited in this invention are considerably inferior to the steels according to this invention in the fatigue strength and the machinability because the balance among the C, Mn and Cr contents is not suitable and the oxide composition is not controlled positively by silicon, calcium, aluminum and oxygen.

As mentioned above, in the high strength non-heat refining free cutting steel according to this invention having the aforementioned chemical composition and microstructure, the toughness of the matrix is improved by settling amounts of carbon, manganese and chromium so as to be well-balanced, the composition of oxides is controlled so as to improve the machinability by adjusting amounts of silicon, calcium, aluminum and oxygen within the suitable range respectively, and amounts of sulfur and lead effective to improve the machinability still more are contained within the restricted range so as not to affect the strength of the steel. Therefore, an excellent effect can be obtained since it is possible to obtain high strength in addition to the excellent machinability without heat treatment such as quenching-and-tempering.

What is claimed is:

1. A high strength non-heat refining free cutting steel consisting essentially by weight percentage of 0.30 to 0.50% of C, 0.35 to 0.70% of Si, 0.80 to 1.40% of Mn, 0.30 to 0.80% of Cr, 0.05 to 0.35% of V, not more than 0.15% of S and not more than 0.35% of Pb so that (S+Pb) is not less than 0.06% and (S+Pb/4) is not more than 0.15%, 0.0003 to 0.0050% of Ca, not more than 0.010% of Al, 0.0015 to 0.0030 of O and the balance of being Fe and inevitable impurities, and having a microstructure composed of 10 to 40% of ferrite and balanced pearlite by area percentage after hot working and air cooling.

2. A high strength non-heat refining free cutting steel as set forth in claim 1, wherein the weight percentage of C is not more than 0.45%.

3. A high strength non-heat refining free cutting steel as set forth in claim 1, wherein the weight percentage of Cr is not more than 0.70%.

4. A high strength non-heat refining free cutting steel as set forth in claim 2, wherein the weight percentage of Cr is not more than 0.70%.

* * * * *